US005203610A

United States Patent [19]

Miller

[11] Patent Number: 5,203,610

[45] Date of Patent: Apr. 20, 1993

[54] RECLINING LIFT CHAIR HAVING WHEELS FOR TRANSPORT

[75] Inventor: Robert E. Miller, Deltona, Fla.

[73] Assignee: Invacare Corporation, Elyria, Ohio

[21] Appl. No.: 612,793

[22] Filed: Nov. 14, 1990

[51] Int. Cl.[5] ..... A47C 1/02

[52] U.S. Cl. ..... 297/345; 297/344; 297/DIG. 4; 297/DIG. 10; 280/43.24

[58] Field of Search ..... 297/344, 345, DIG. 4, 297/DIG. 7, DIG. 10; 248/395, 396, 398; 280/43.24 X, 43.14

[56] References Cited

U.S. PATENT DOCUMENTS

| | | | |
|---|---|---|---|
| 635,613 | 10/1899 | Thompson | 297/345 X |
| 2,537,909 | 1/1951 | Puddester | 280/43.24 X |
| 2,798,232 | 7/1957 | Ericsson | 280/43.24 X |
| 3,179,438 | 4/1965 | Field | 280/43.14 |
| 4,007,960 | 2/1977 | Gaffney | 297/DIG. 10 X |
| 4,083,599 | 4/1978 | Gaffney | 297/DIG. 10 X |
| 4,125,269 | 11/1978 | Kiel | 297/DIG. 4 X |
| 4,510,633 | 4/1985 | Thorne | 297/345 X |

*Primary Examiner*—Kenneth J. Dorner
*Assistant Examiner*—Milton Nelson, Jr.
*Attorney, Agent, or Firm*—Fay, Sharpe, Beall, Fagan, Minnich & McKee

[57] ABSTRACT

A powered reclining lift chair includes a first base member for supporting the chair during the lift mode and a second base member having wheels for selectively transporting the chair from one location to another. The chair is operable through both lift and recline modes, as well as being manually actuated in a lowered position to transfer a portion of the chair weight to the second base member as desired. The manual actuation member is biased toward a first position that maintains two of the wheels above the ground surface.

11 Claims, 7 Drawing Sheets

RECLINING LIFT CHAIR HAVING WHEELS FOR TRANSPORT

BACKGROUND OF THE INVENTION

This invention pertains to the art of lift chairs and more particularly to a reclining lift chair.

The invention is applicable to a mobile reclining lift chair and will be described with reference thereto.

Reclining lift chairs are well known in the art. U.S. Pat. Nos. 3,138,402 and 4,007,960 are representative of chairs that use a single motor to both lift and recline. Operating the motor in one direction from a normal seated position lifts the chair from the floor. This aids a chair occupant in exiting the chair. Operation of the motor in the opposite direction from the normal seated position permits the occupant to achieve a reclined position.

Still other chairs may be selectively converted to a mobile chair. Patents generally representative of this feature are U.S. Pat. Nos. 864,374 and 4,083,599. The latter patent also incorporates a power lift function into the arrangement.

Unfortunately, none of the prior art effectively combines all of these features into a single chair. That is, selected ones of these structures only lift and recline, but offer no option to facilitate in ease of moving the chair from one location to another. Selected other structures do not lift or provide mobility features. Further, still other structures operate as (i) a lift chair and a mobile chair or alternativley as (ii) a lift chair and as a rocker. None effectively combines all the features of lifting, reclining, and mobility.

SUMMARY OF THE INVENTION

The present invention contemplates a new and improved reclining lift chair that includes wheels to aid in transporting the chair.

According to the present invention, there is provided a seat and first base member, and means for moving the seat relative to the first base member between raised and lowered positions. Means for positioning a second base member in contact with the floor, simultaneously with the first base member, is provided .

According to a more limited aspect of the invention, the second base member includes a set of wheels.

According to another aspect of the invention, a manual actuating means for the second base member is biased toward a first, de-actuated position.

According to a still further aspect of the invention, the lift chair includes means for reclining the chair between upright and reclined positions.

According to yet another aspect of the invention, a single means for raising and lowering the seat, and moving the seat between upright and reclined positions is provided.

A principal advantage of the invention resides in the ability to combine the lifting, reclining, and mobility features in a single chair.

Another advantage of the invention resides in a chair that shares the weight between first and second base members for transport to prevent inadvertent sliding of the chair when an occupant seats himself.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts embodiment of which will be described in detail spec and illustrated in the accompanying drawings which form a part hereof, and wherein.

DETAILED DESCRIPTION OF THE PREFERRED EMBODIMENT

Figure 1:
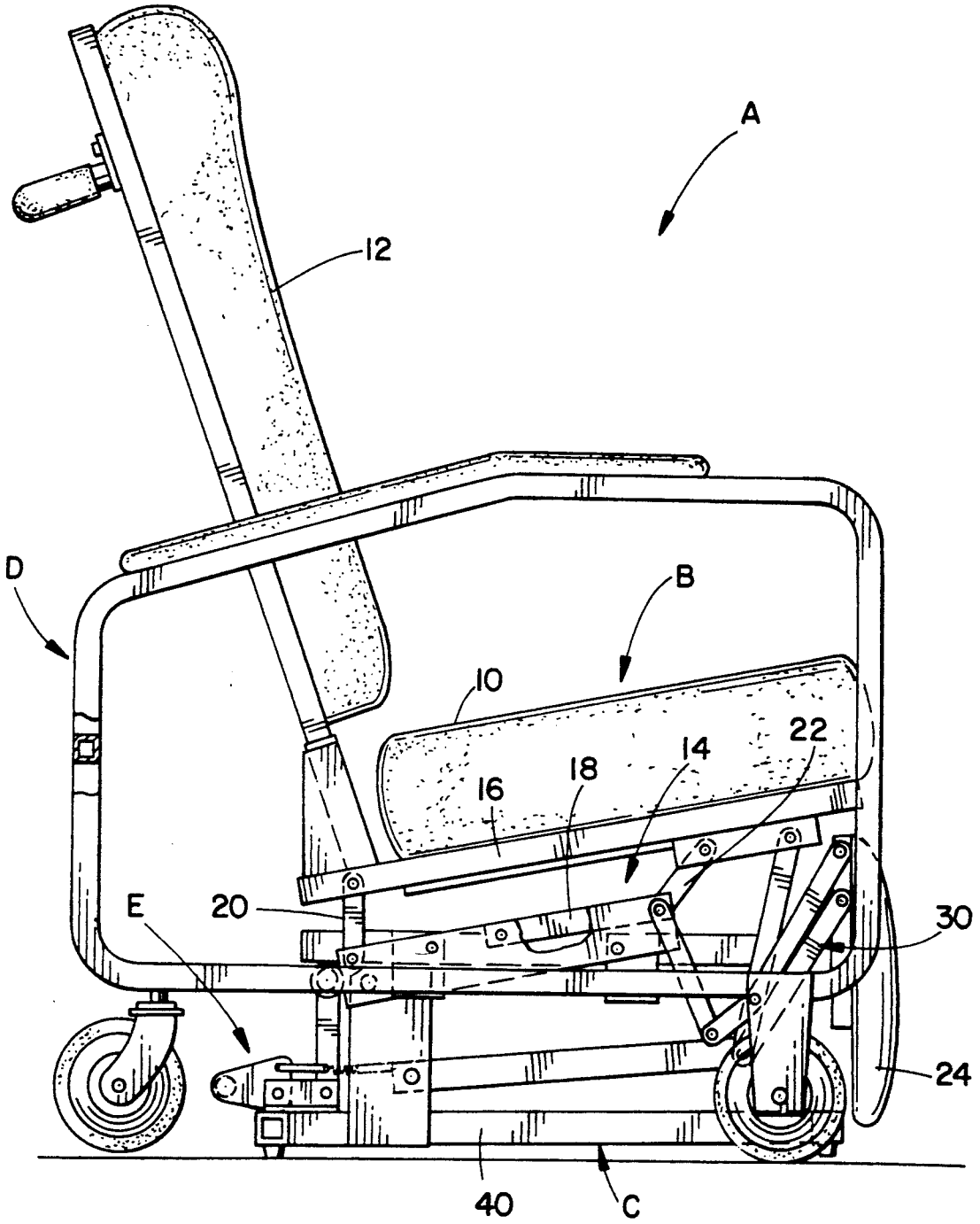
FIG. 1 is a side elevational view of the subject chair in a normal position.

Referring now to the drawings wherein the showings are for purposes of illustrating the preferred embodiment of the invention only and not for purposes of limiting same, the FIGURES show a mobile, reclining lift chair A having a seat B that is selectively raised and lowered relative to a first base member C. The seat is also adapted for movement between normal and reclined positions. A second base member D is secured to the seat and shares the weight of the chair during lowered positions. A manual actuating means E transfers a greater amount of weight to the second base member, while retaining the first base member in contact with the floor.

More particularly, the seat B includes a seat portion 10 and a seat back 12 disposed in fixed relation relative to one another. That is, the angle defined between the seat portion and seat back never varies during the various movements of the seat. In the preferred arrangement, the seat includes a metal framework on which cushions are provided to define the seat portion and seat back. Secured to the base of the seat frame is a two-way hinge which is a conventional four bar linkage 16, 18, 20, 22 that permits the seat to move between an upright position (FIG. 1) and a reclined position (FIG. 3) in which a leg rest 24 extends outwardly from the chair to support an occupant's legs during the reclined mode.

More specifically, the four bar linkage is a non-parallelogram arrangement in which the first leg 16 of the linkage is fixedly secured to the base of the seat portion 10. The second leg 18 is secured to the second base member. The non-parallel legs 20, 22 thus extend between the first and second legs to provide the reclining action typical in a two-way recliner.

Figure 2:
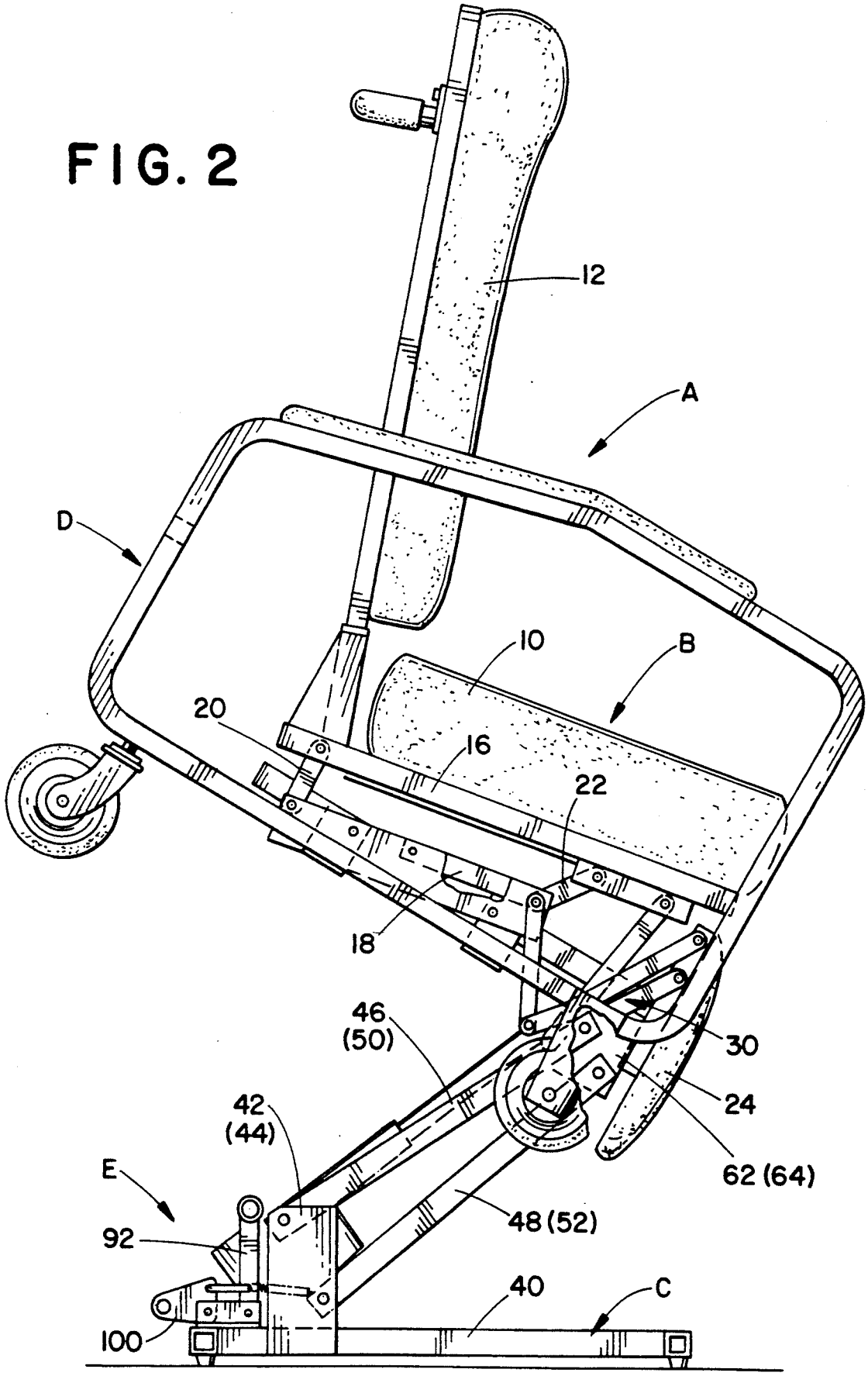
FIG. 2 is a side elevational view of the chair in a lift position.
Figure 3:
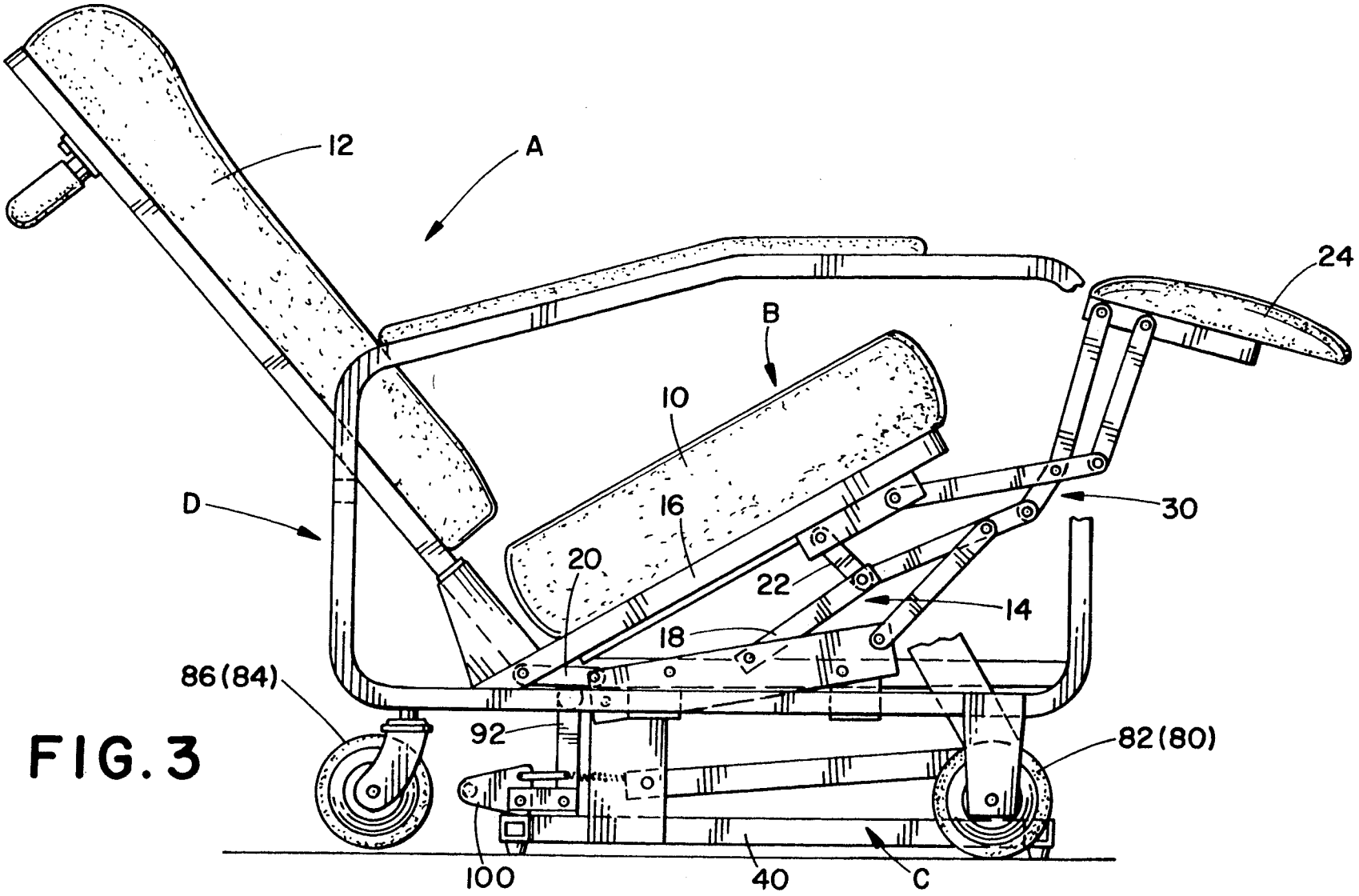
FIG. 3 is a side elevational view of the subject chair in a reclined position.
Figure 4:
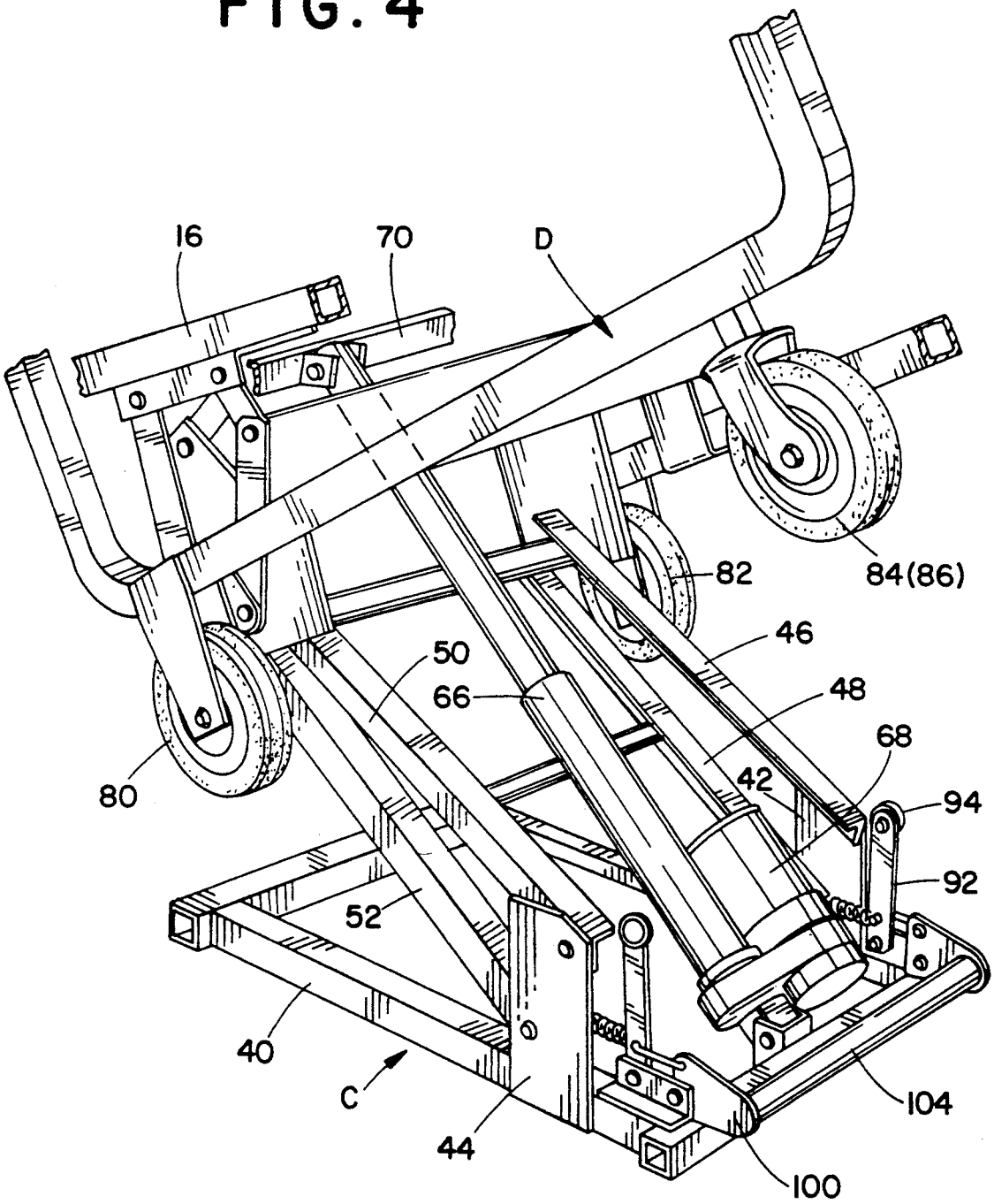
FIG. 4 is a rear view of the chair in a raised position.
Figure 5:
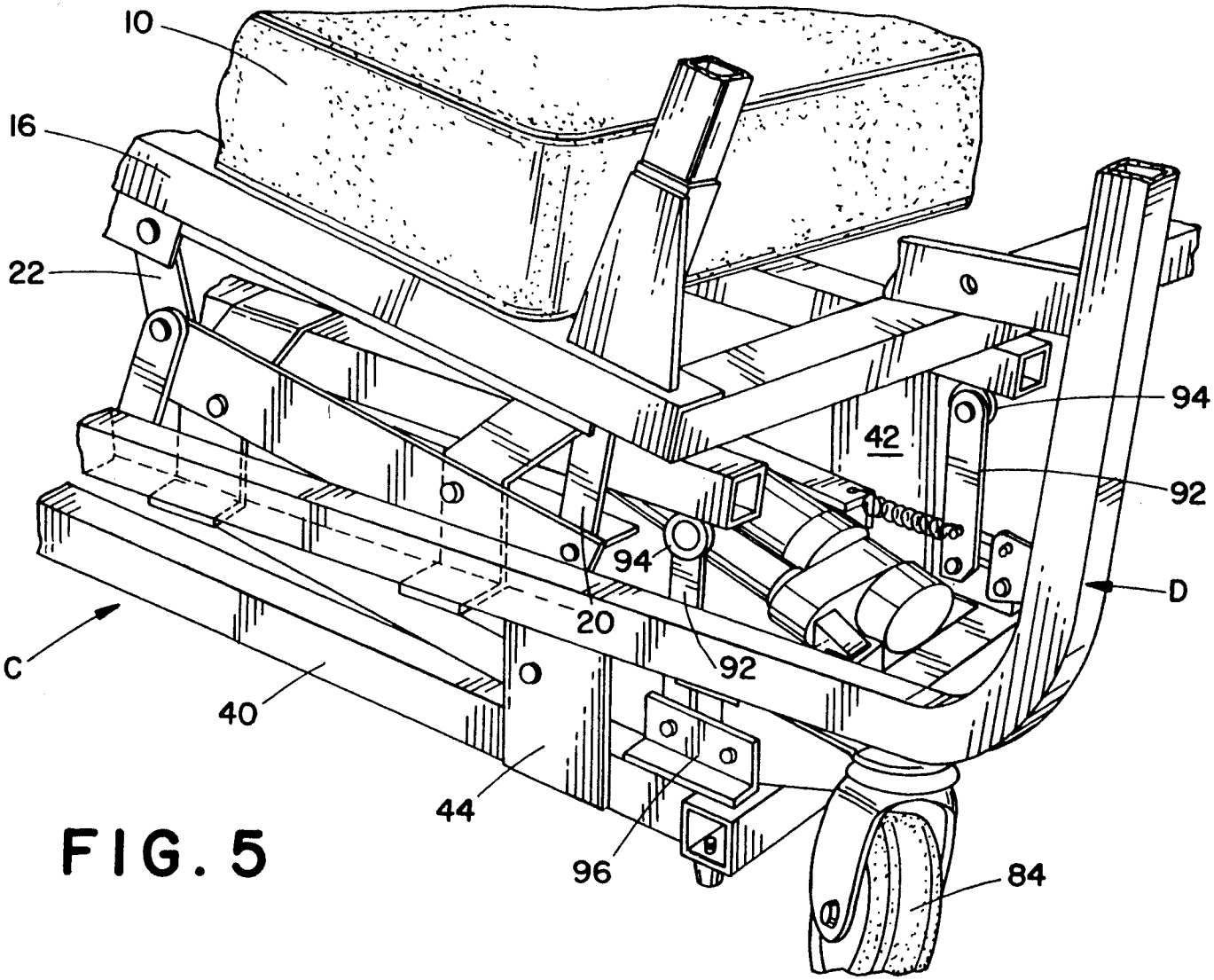
FIG. 5 is a view showing the chair in a normal position and the manual actuating means for the second base member in a deactuated position.
Figure 6:
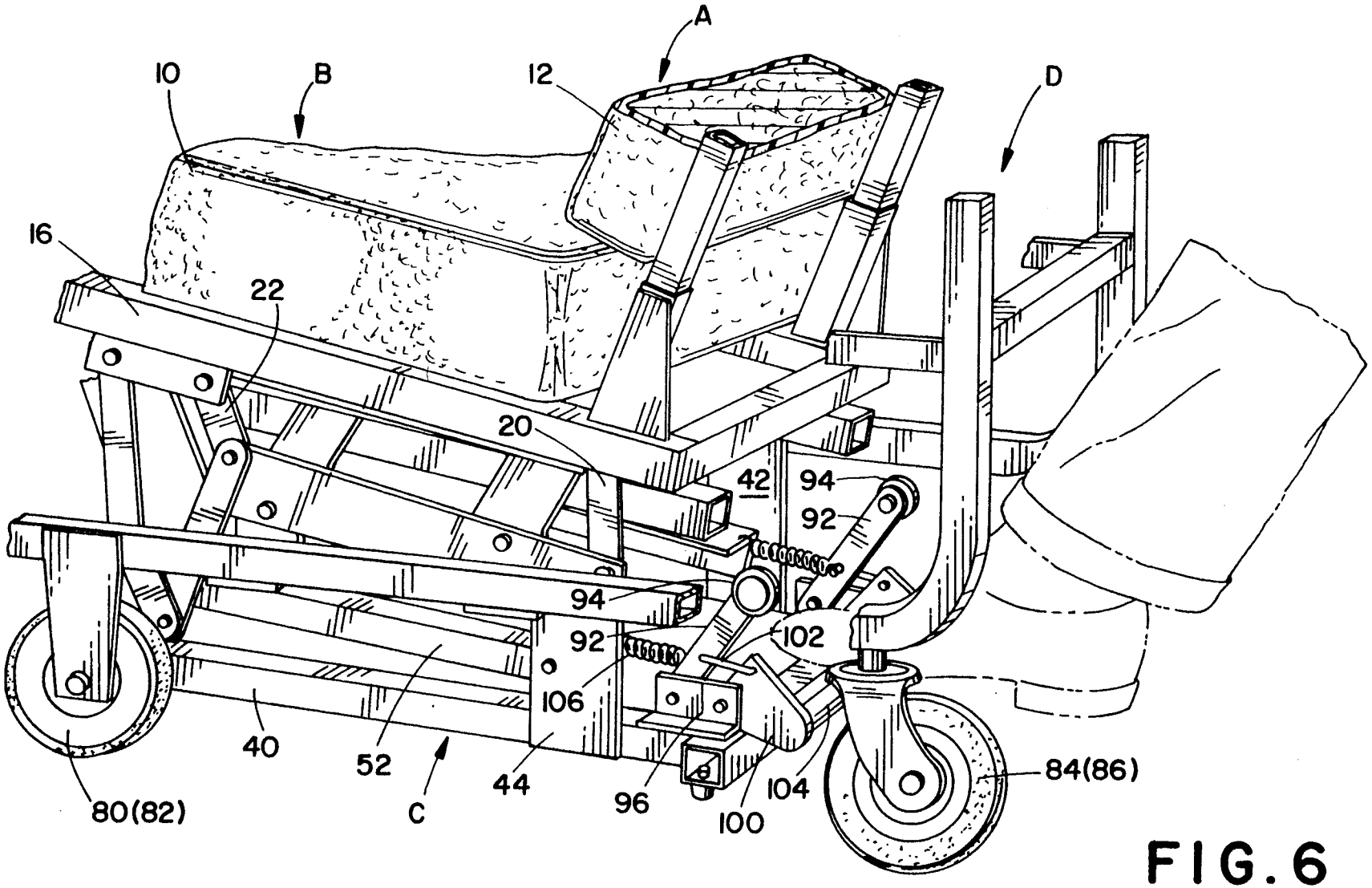
FIG. 6 is a view similar to FIG. 5 showing the manual actuating means in an actuated position.

A scissors linkage mechanism 30 is also associated with the four bar linkage to extend the leg rest 24 during the reclining action of the seat. As the second leg 18 moves leftwardly (as shown in FIGS. 5 and 6) relative to the first leg, the scissors linkage mechanism is extended and raises the leg rest 24 from a retracted position (FIGS. 1 and 2) to an extended position (FIG. 3). Again, the structure and operation of a two-way recliner employing a four bar linkage with the scissors linkage mechanism is well known in the art. Therefore, further discussion of its structure and operation is deemed unnecessary to a complete understanding of the subject invention.

The first base member C is dimensioned to be received beneath the chair in its normal seated position. More particularly, the base member is defined by a frame 40 to which are fixedly secured upstanding first and second flanges 42, 44. Extending from flange 42 are a pair of non-parallel link arms 46, 48 and, similarly, extending from flange 44 are a pair of link arms 50, 52. The opposite ends of these link arms are connected to flanges 62, 64 which are secured to the seat. Pin connections are provided at the opposite ends of the link arms to selectively raise and lower the seat relative to the first base member.

An extensible ram 66 powered by motor 68 is connected at one end to the frame 40. The opposite end of the ram is connected to bar 70 that extends beneath the seat portion 10. Extension of the ram by running the motor in a first direction lifts the seat from its normal position (FIG. 1) via the non-parallel link arms 46, 48, 50, 52 to a lift position shown in FIG. 2. Reversing the motor and retracting the ram lowers the seat from the FIG. 2 position to the normal position in FIG. 1. Further retraction of the ram pulls the first leg 16 of the four bar linkage 14 rightwardly relative to the second leg and begins reclining the seat and extending the foot rest until the seat achieves the FIG. 3 position.

In accordance with the subject invention, a second base member D includes first, second, third, and fourth wheels 80, 82, 84, 86 depending therefrom. As the seat is lowered from the lift position of FIG. 2 to the normal position of FIG. 1, the front wheels 80, 82 engage the ground surface. This action slightly lifts the front end of frame 40 from the ground surface. The rear end of the frame, though, remains in contact with the ground surface and partially supports the weight of the chair. Further, the rear wheels 84, 86 lightly engage the ground surface in the normal position of the chair.

If an occupant desires to move the chair, the power cord (not shown) is first unplugged from an electrical outlet. Then a manual actuation means 90 is depressed or actuated to allow the chair to be transported to a different location.

Figure 7:
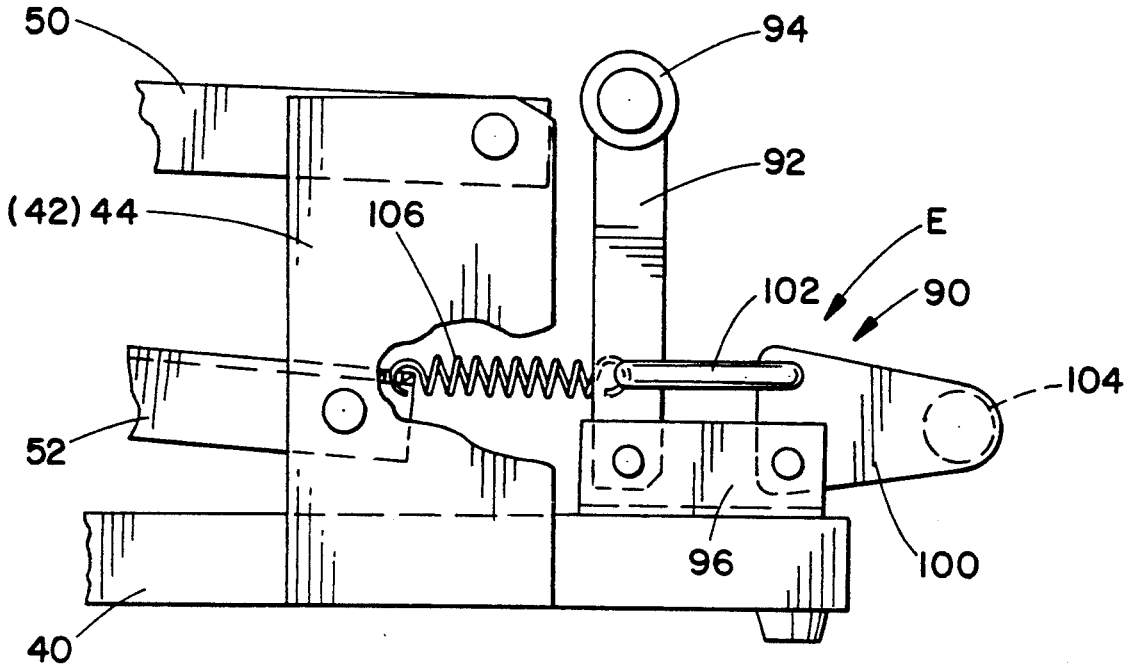
FIG. 7 is an enlarged, detailed view of the manual actuating means in a de-actuated position.
Figure 8:
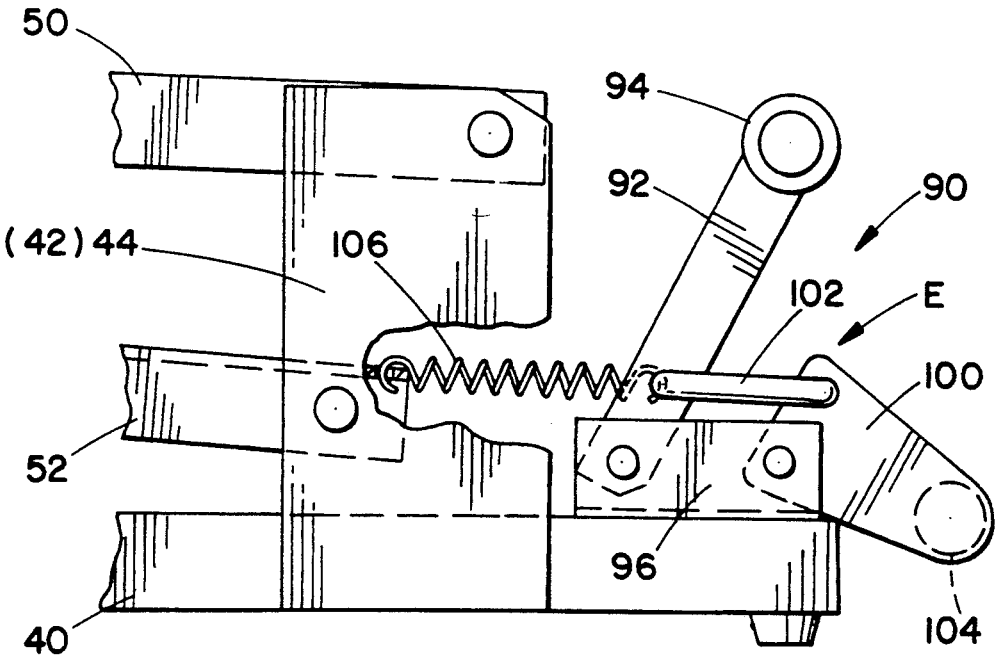
FIG. 8 is an enlarged, detail view of the actuating means in an actuated position.

The manual actuation means 90 is more particularly illustrated in FIGS. 7 and 8. As shown, the manual actuation means includes a lever 92 having a roller 94 at one end. The other end of the lever is pivotally connected to arm 96. The arm is, in turn, fixedly secured to the frame 40. The arm also pivotally receives an irregularly shaped element 100. A link member 102 also interconnects the element and the lever together.

An identical structural arrangement is disposed on the other side of the frame 40, with a foot depressing element 104 extending between the elements 100. A biasing means defined by spring 106 urges the lever 92 toward an upright or de-actuated position. The spring has one end attached to the lever and another end attached to the frame 40. Thus, the lever is always urged toward an upright position and is adapted to engage the second base member D. In this manner, the second base member cannot bottom out or engage link arm 48 and the rear wheels 84, 86 only lightly engage the ground surface.

If the foot element 104 is depressed, i.e., the manual actuating means actuated, the lever 92 is rotated against the bias of the spring by means of link 102 This removes the roller from a supporting position beneath the second base member and transfers a portion of the chair weight to the rear wheels. Thus, although the rear end of the frame 40 still engages the ground surface, it carries less chair weight. Therefore, an occupant can be pushed in the chair to a different location, merely overcoming the slight resistance offered by the base member C.

Once the seat has been wheeled to a new location, the power plug can be inserted into the outlet and the chair operated in the lift and recline modes as desired.

Having thus described the invention, it is now claimed:

1. A lift chair for raising and lowering an occupant above a floor, the lift chair comprising:

a seat having a seat back and a seat portion;

a first base member constantly engaging the floor;

means for selectively moving the seat relative to the first base member between raised and lowered positions;

a second base member operatively associated with the seat and a portion of the second base member in at least partial engagement with the floor in a seat lowered position; and manual means for selectively actuating the second base member into full contact with the floor, the actuation of the manual means providing for redistributed and shared support of the seat between the first and second base members, the manual actuating means including a lever operatively associated with the first base member and extending outwardly therefrom for selective engagement with the seat, and the lever being pivotable about a pin for selective retraction away from engagement with the seat.

2. The lift chair as defined in claim 1 wherein the second base member includes wheels for aiding in movement of the lift chair.

3. The lift chair as defined in claim 2 wherein the wheels extend outwardly from the second base member a distance to contact the floor only when the seat is in a lowered position.

4. The lift chair as defined in claim 3 wherein the manual actuating means is biased toward a first, de-actuated position for engagement with the seat.

5. A reclining lift chair for raising and lowering an occupant above a floor, and reclining an occupant between upright and reclined positions, the reclining lift chair comprising:

a seat having a seat back and a seat portion;

a first base member engaging the floor;

single means for selectively moving the seat between raised and lowered positions, and between upright and reclined positions;

a second base member operatively associated with the seat and a portion of the second base member in at least partial engagement with the floor in a seat lowered position; and manual means for selectively actuating the second base member into full contact with the floor, the manual actuating means including a first portion secured to the first base member and a lever pivotally secured to the first portion for movement between actuated and de-actuated positions, the lever having a first end for engaging the seat in a seat lowered position when the lever is in its de-actuated position, and spaced from the seat in its actuated position the actuation of the manual means providing for shared support of the seat between the first and second base members.

6. The reclining lift chair as defined in claim 5 wherein the manual actuating means includes means for biasing the lever to the de-actuated positions.

7. A lift chair for raising and lowering an occupant above a floor, the lift chair comprising:

a seat having a seat back and a seat portion;

a first base member constantly engaging the floor;

ram means powered by a motor for selectively moving the seat relative to the first base member between raised and lowered positions;

a second base member operatively associated with the seat and being moved with the seat during raising and lowering thereof, the second base member including two pairs of wheels for assisting in movement of the chair, one pair of the wheels engaging the floor during a seat lowered position; and manual means for selectively actuating the second pair of wheels of the second base member into full contact with the floor, the actuation of the manual means redistributing support of the lift chair between the first and second base members.

8. The lift chair as defined in claim 7 wherein the actuating means is pivotally secured to the first base member for selective movement between first and second positions.

9. The lift chair as defined in claim 8 further comprising means for biasing the actuating means toward a first position supporting the second base member in a seat lowered position.

10. A reclining lift chair for raising and lowering an occupant above a floor, and reclining an occupant between upright and reclined positions, the reclining lift chair comprising:

a seat having a seat back and a seat portion;

a first base member constantly engaging the floor;

means for selectively moving the seat between raised and lowered positions, and between upright and reclined positions;

a second base member operatively associated with the seat and a portion of the second base member in at least partial engagement with the floor in a seat lowered position; and manual means for selectively actuating the second base member into full contact with the floor, the manual actuating means including a first portion secured to the first base member and a lever pivotally secured to the first portion for movement between actuated and de-actuated positions, the lever having a first end for engaging the seat in a seat lowered position when the lever is in its de-actuated position, and spaced from the seat in its actuated position to provide for shared support of the seat between the first and second base members.

11. The reclining lift chair as defined in claim 10 wherein the manual actuating means includes means for biasing the lever to the de-actuated position.

* * * * *